US010950919B2

(12) United States Patent
Kamgaing et al.

(10) Patent No.: US 10,950,919 B2
(45) Date of Patent: Mar. 16, 2021

(54) SYSTEM COMPRISING FIRST AND SECOND SERVERS INTERCONNECTED BY A PLURALITY OF JOINED WAVEGUIDE SECTIONS

(71) Applicant: Intel Corporation, Santa Clara, CA (US)

(72) Inventors: Telesphor Kamgaing, Chandler, AZ (US); Georgios C. Dogiamis, Chandler, AZ (US); Sasha N. Oster, Chandler, AZ (US); Adel A. Elsherbini, Chandler, AZ (US); Brandon M. Rawlings, Chandler, AZ (US); Aleksandar Aleksov, Chandler, AZ (US); Shawna M. Liff, Scottsdale, AZ (US); Richard J. Dischler, Bolton, MA (US); Johanna M. Swan, Scottsdale, AZ (US)

(73) Assignee: Intel Corporation, Santa Clara, CA (US)

( * ) Notice: Subject to any disclaimer, the term of this patent is extended or adjusted under 35 U.S.C. 154(b) by 44 days.

(21) Appl. No.: 16/325,522

(22) PCT Filed: Sep. 30, 2016

(86) PCT No.: PCT/US2016/054888

§ 371 (c)(1),
(2) Date: Feb. 14, 2019

(87) PCT Pub. No.: WO2018/063362

PCT Pub. Date: Apr. 5, 2018

(65) Prior Publication Data

US 2019/0198965 A1 Jun. 27, 2019

(51) Int. Cl.
*H01P 5/02* (2006.01)
*H01P 3/12* (2006.01)
(Continued)

(52) U.S. Cl.
CPC ..... *H01P 5/02* (2013.01); *H01P 1/022* (2013.01); *H01P 1/042* (2013.01); *H01P 3/122* (2013.01); *H01P 3/16* (2013.01); *H01P 11/002* (2013.01)

(58) Field of Classification Search
CPC .. H01P 1/042; H01P 1/022; H01P 5/02; H01P 3/16
(Continued)

(56) References Cited

U.S. PATENT DOCUMENTS 5,148,593 A * 9/1992 Walter ..... H01P 1/04 174/102 D
8,816,799 B2 * 8/2014 Nealis et al. ..... H01P 11/002 333/254
(Continued)

FOREIGN PATENT DOCUMENTS

JP 2008244857 A 10/2008
WO WO-2018063362 A1 4/2018

OTHER PUBLICATIONS

"International Application Serial No. PCT/US2016/054888, International Search Report dated Apr. 25, 2017", 3 pgs.
(Continued)

*Primary Examiner* — Benny T Lee
(74) *Attorney, Agent, or Firm* — Schwegman Lundberg & Woessner, P. A.

(57) ABSTRACT

An apparatus comprises a waveguide section including an outer layer of conductive material tubular in shape and having multiple ends; and a joining feature on at least one of the ends of the waveguide section configured for joining to a second separate waveguide section.

21 Claims, 6 Drawing Sheets

(51) Int. Cl.

| | |
|---|---|
| ***H01P 3/16*** | (2006.01) |
| ***H01P 1/04*** | (2006.01) |
| ***H01P 1/02*** | (2006.01) |
| ***H01P 11/00*** | (2006.01) |

(58) Field of Classification Search
USPC ..... 333/248, 254
See application file for complete search history.

(56) References Cited

U.S. PATENT DOCUMENTS

| | | | | |
|---|---|---|---|---|
| 9,912,032 | B2 * | 3/2018 | Morgan et al. | H01P 3/16 |
| 2009/0058571 | A1 | 3/2009 | Takemoto et al. | |
| 2014/0097917 | A1 | 4/2014 | Shah et al. | |
| 2014/0368301 | A1 | 12/2014 | Herbsommer et al. | |
| 2016/0064795 | A1 | 3/2016 | Chang et al. | |
| 2017/0040659 | A1 * | 2/2017 | Morgan et al. | H01P 3/16 |

OTHER PUBLICATIONS

"International Application Serial No. PCT/US2016/054888, Written Opinion dated Apr. 25, 2017", 8 pgs.
"International Application Serial No. PCT/US2016/054888, International Preliminary Report dated Apr. 11, 2019", 10 pgs.

* cited by examiner

SYSTEM COMPRISING FIRST AND SECOND SERVERS INTERCONNECTED BY A PLURALITY OF JOINED WAVEGUIDE SECTIONS

CLAIM OF PRIORITY

This patent application is a U.S. National Stage Application under 35 U.S.C. 371 from International Application No. PCT/US2016/054888, filed Sep. 30, 2016, published as WO2018/063362, which is incorporated herein by reference.

TECHNICAL FIELD

Embodiments pertain to high speed interconnections in electronic systems, and more specifically to waveguides for implementing communication interfaces between electronic devices.

BACKGROUND

As more electronic devices become interconnected and users consume more data, the demand on server system performance continues to increase. More and more data is being stored in internet "clouds" remote from devices that use the data. Clouds are implemented using servers arranged in server clusters (sometimes referred to as server farms). The increased demand for performance and capacity has led server system designers to look for ways to increase data rates and increase the server interconnect distance in switching architectures while keeping power consumption and system cost manageable.

Within server systems and within high performance computing architectures there can be multiple levels of interconnect between electronic devices. These levels can include within blade interconnect, within rack interconnect, rack-to-rack interconnect and rack-to-switch interconnect. Shorter interconnect (e.g., within rack interconnect and some rack-to-rack interconnect) is traditionally implemented with electrical cables (e.g., Ethernet cables, co-axial cables, twin-axial cables, etc.) depending on the required data rate. For longer distances, optical cables are sometimes used because fiber optic solutions offer high bandwidth for longer interconnect distances.

However, as high performance architectures emerge (e.g., 100 Gigabit Ethernet), traditional electrical approaches to device interconnections that support the required data rates are becoming increasingly expensive and power hungry. For example, to extend the reach of an electrical cable or extend the bandwidth of an electrical cable, higher quality cables may need to be developed, or advanced techniques of one or more of equalization, modulation, and data correction may be employed which increases the power consumption of the system and adds latency to the communication link. For some desired data rates and interconnect distances, there is presently not a viable solution. Optical transmission over optical fiber offers a solution, but at a severe penalty in power and cost. The present inventors have recognized a need for improvements in the interconnection between electronic devices.

DETAILED DESCRIPTION OF THE INVENTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Traditional electrical cabling may not meet the emerging requirements for electronic systems such as server clusters. Fiber optics may meet the performance requirements, but may result in a solution that is too costly and power hungry. A waveguide can be used to propagate electromagnetic waves including electromagnetic waves having a wavelength in millimeters (mm) or micrometers (μm) range. A transceiver and an antenna (sometimes referred to as a "waveguide launcher") can be used to send electromagnetic waves along the waveguide from the transmitting end and receive propagated electromagnetic waves at the receiving end. Waveguides offer the bandwidth needed to meet the emerging requirements. However, a conventional waveguide can be prone to buckling or kinking when trying to connect the waveguide if the connection requires bending of the waveguide.

Figure 1:
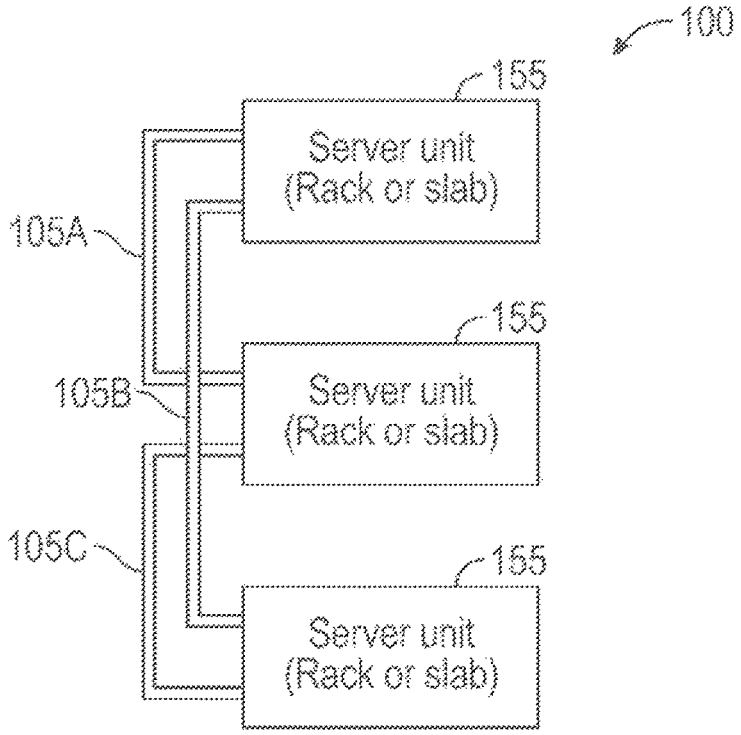
FIG. 1 is an illustration of an embodiment of a server system in accordance with some embodiments.

FIG. 1 is an illustration of an embodiment of a server system 100. A server system can include many server units 155 although only three server units are shown in the example of FIG. 1 to simplify the diagram. The server units 155 may be included in a server unit rack or slab and are interconnected using only three waveguides 105A, 105B, and 105C although the actual interconnect between server units in an implemented server system can include hundreds of such interconnections.

Figure 2:
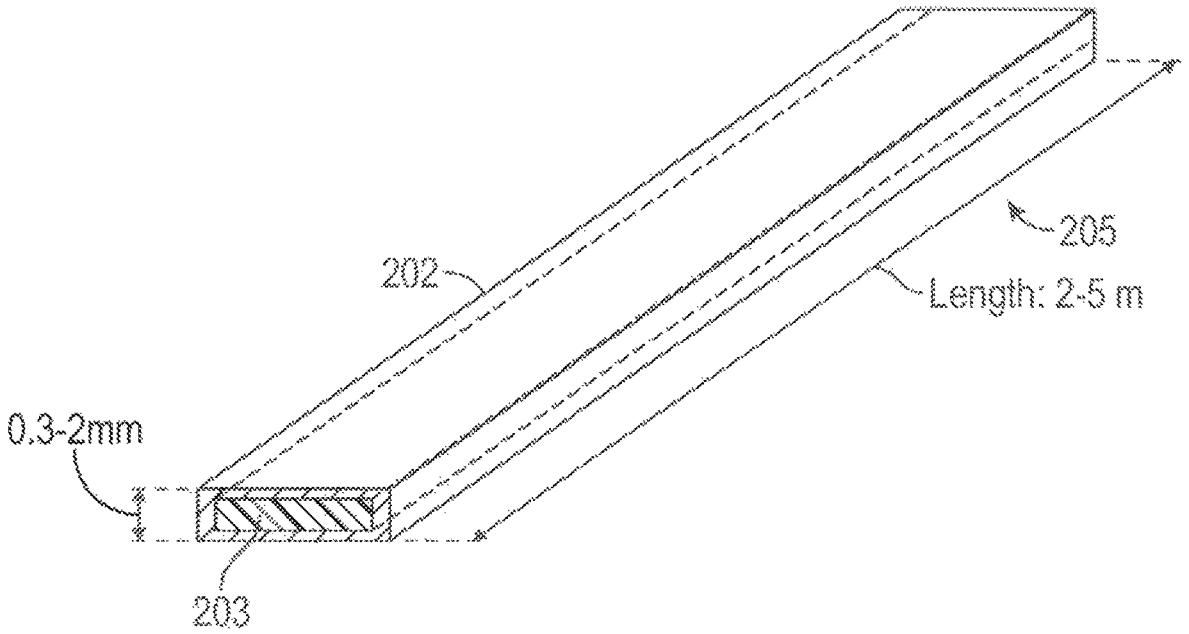
FIG. 2 is an illustration of an embodiment of a waveguide in accordance with some embodiments.

FIG. 2 is an illustration of an embodiment of a waveguide. The waveguide in the example has a rectangular cross section with a height of 0.3-2 millimeters (mm) and has a length of 2-5 meters (m). While the illustrated waveguide has a rectangular cross section, it should be understood that other cross sectional shapes including circular, hexagonal, orthogonal, etc.) may be used as well. The waveguide 205 includes an outer layer 202 of conductive material such as metal. The waveguide can include a waveguide core 203 that includes a dielectric material within the outer layer of conductive material. A waveguide can be a hollow or filled metal waveguide or can be a conductively coated or uncoated dielectric waveguide. In some embodiments, a waveguide can include an outer layer that is a second dielectric layer that is non-conductive. A waveguide that includes a conductive outer layer and a waveguide core of dielectric material can reduce signal loss. The waveguides

105A, 105B, and 105C, shown in FIG. 1 can be fabricated as a single continuous straight waveguide. However, connection of the waveguides can result in corners or bends that may have rounded sections and squeezed cross sectional dimensions. These features can result in mismatch in the waveguide sections that can cause signal deterioration.

Figure 3C:
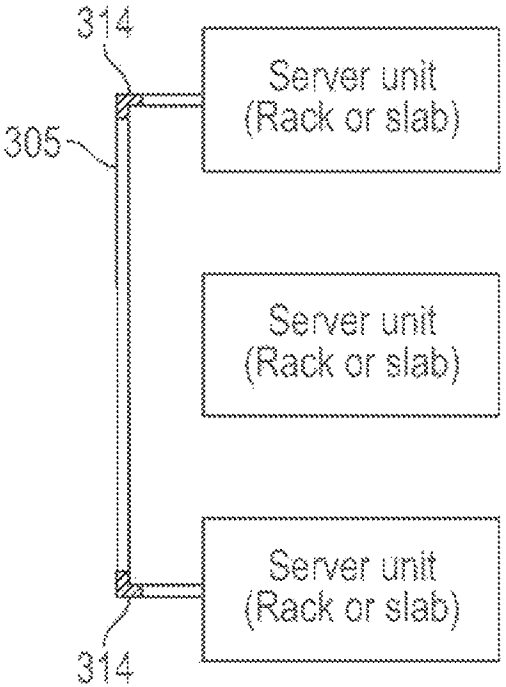
FIGS. 3A-3C are illustrations of additional embodiments of server systems in accordance with some embodiments.
Figure 3B:
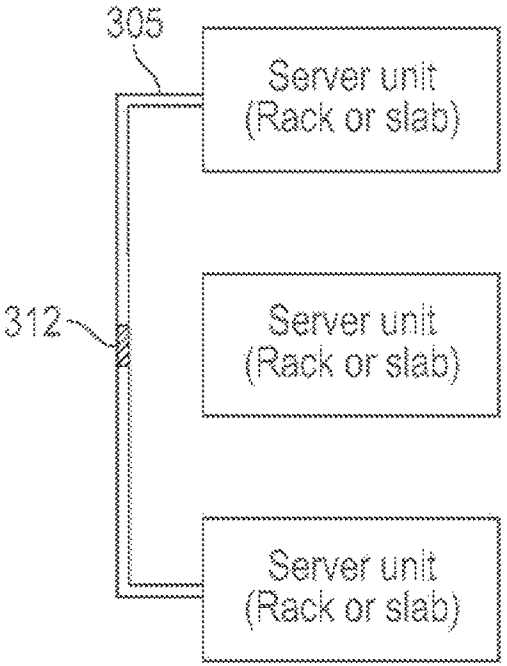
Figure 3A:
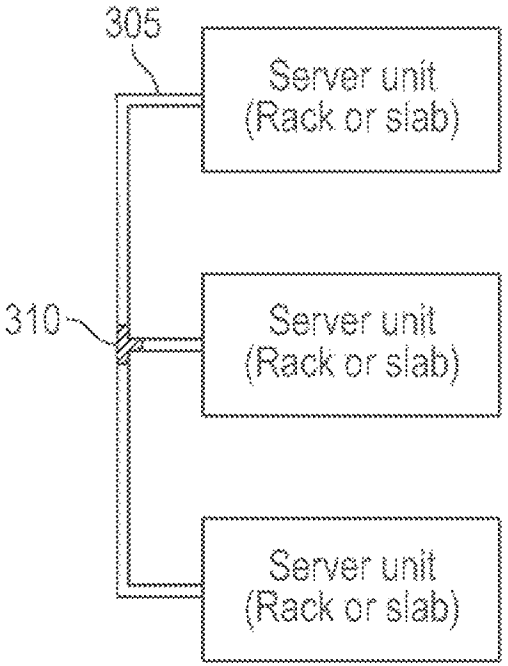

FIGS. 3A-3C are illustrations of additional embodiments of server systems. The interconnection or fabric for the server systems includes waveguides 305 that are made of multiple prefabricated waveguide sections that are joined together to implement the interconnection between server units of the rack or slab type. The waveguide sections can be hollow and used in assembling a hollow waveguide, or can include a dielectric waveguide core to assemble a waveguide with a waveguide core. The embodiment of FIG. 3A includes a waveguide section 310 having a "T" shape. The embodiment of FIG. 3B includes a waveguide section 312 having an "I" shape. The embodiment of FIG. 3C includes a waveguide sections 314 having an "L" shape. The L-shape waveguide sections can provide corners or bends with uniform cross sections to reduce signal deterioration. The T-shape waveguide sections can also provide corners or bends with uniform waveguide cross sections. In addition, T-shape waveguide sections can reduce the amount of waveguides needed for server system interconnection. For example, the T-shape waveguide section of FIG. 3A has three ends and allows for one waveguide to interconnect all three server units, whereas the example of FIG. 2 requires three waveguides to interconnect the three server units. The waveguide of FIG. 3A includes two branches, and one of the branches may be inactivated while the other branch is active to avoid propagating a signal to an unused branch of a waveguide. Inactivating a branch may include providing an adaptive impedance termination circuit in a multi-branch waveguide to avoid unwanted signal propagation.

Figure 4A:
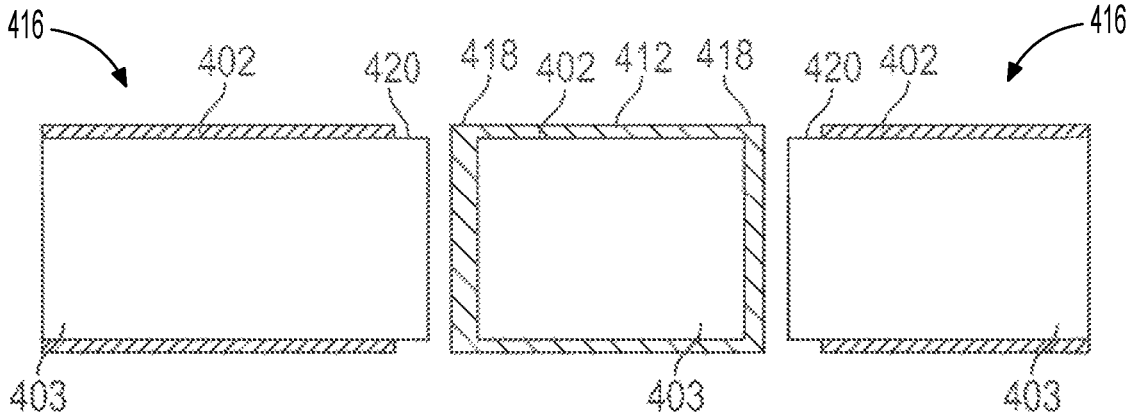
FIGS. 4A and 4B are illustrations of waveguide sections that can be assembled into a single waveguide in accordance with some embodiments.
Figure 4B:
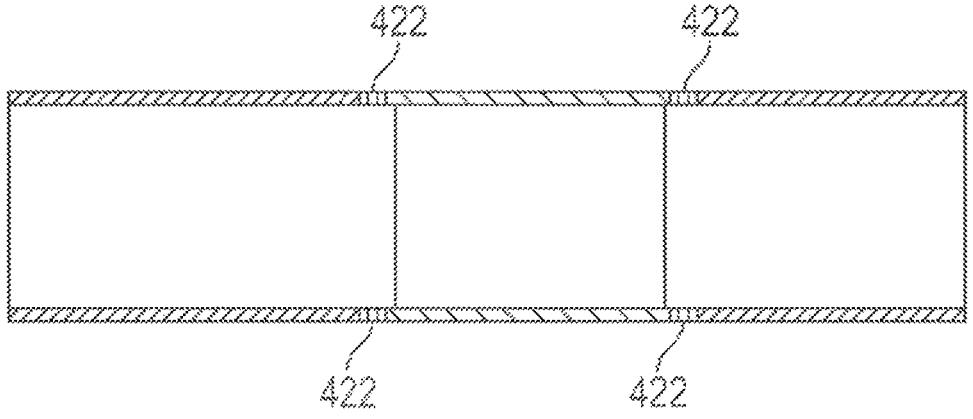

FIGS. 4A and 4B are illustrations of waveguide sections that can be assembled into a single waveguide. As shown in FIG. 4A, the waveguide sections include a center "I" shaped section 412 and two end sections 416. The waveguide sections in the example include an outer layer 402 of conductive material and a waveguide core 403 of dielectric material within the outer layer. The conductive material may include a conductive polymer (such as a polyaniline (PAM), or poly(3,4-ethylenedioxythiophene) polystyrene sulfonate (PEDOT:PSS) for example), or the conductive material of the outer layer may include metal such as one or more of copper, gold, silver, or aluminum. The dielectric material of the waveguide core may include at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE). In some embodiments, the waveguide sections are hollow and do not include a waveguide core.

FIG. 4A illustrates the waveguide sections separated. The waveguide sections can be tubular in shape. The cross section of the waveguide sections can be circular, oval, square, rectangular, or may have a more complex cross section shape. The width of the cross section of the waveguide section may be less than ten millimeters (10 mm). In certain embodiments, the width of the cross section is less than 1 mm. In certain embodiments, the width of the cross section is within the range of 0.3 mm to 2.0 mm. Each section of the waveguide has two ends. The "I" shaped section 412 includes a joining feature 418 on each of the ends. The waveguide end sections include a joining feature 420 at one end. The waveguide end sections are shown short to accommodate the drawings, but one or both of the end sections may be longer. For example, the end sections of the waveguide may be more than one-half meter (0.5*m*) and the center "I" shaped section 412 may be a short section used to join the waveguide end sections. In variations, one end section may be long and the other short.

In FIG. 4A, the waveguide sections include a dielectric waveguide core and the joining feature 420 on the end of the waveguide section is a plug connector for a plug-receptacle connector pair. A portion of the plug connector may include the dielectric waveguide core. The joining feature on the two ends of the "I" shaped section 412 is a receptacle connector of the plug-receptacle pair to receive the plug connector of the end sections. In variations, the "I" shaped section 412 can include two plug connectors or include one plug connector on one end and a receptacle connector on the other end. A "T" shaped waveguide section may include three joining features; one on each of the three ends. Other shapes can be used for waveguide section shapes that include more than three ends and more than three joining features. A waveguide with N ports or ends (N being a positive integer greater than zero) can be used for interconnection to N server units or N blades within a server rack.

If the waveguide is hollow and does not include a waveguide core, the joining features may be formed in the conductive outer layer. The joining mechanism 420 of the waveguide end sections can include a male connector of a male-female connector pair, and the joining mechanism 418 of the "I" shaped section 412 can include the female connector of the male-female connector pair.

Figure 5:
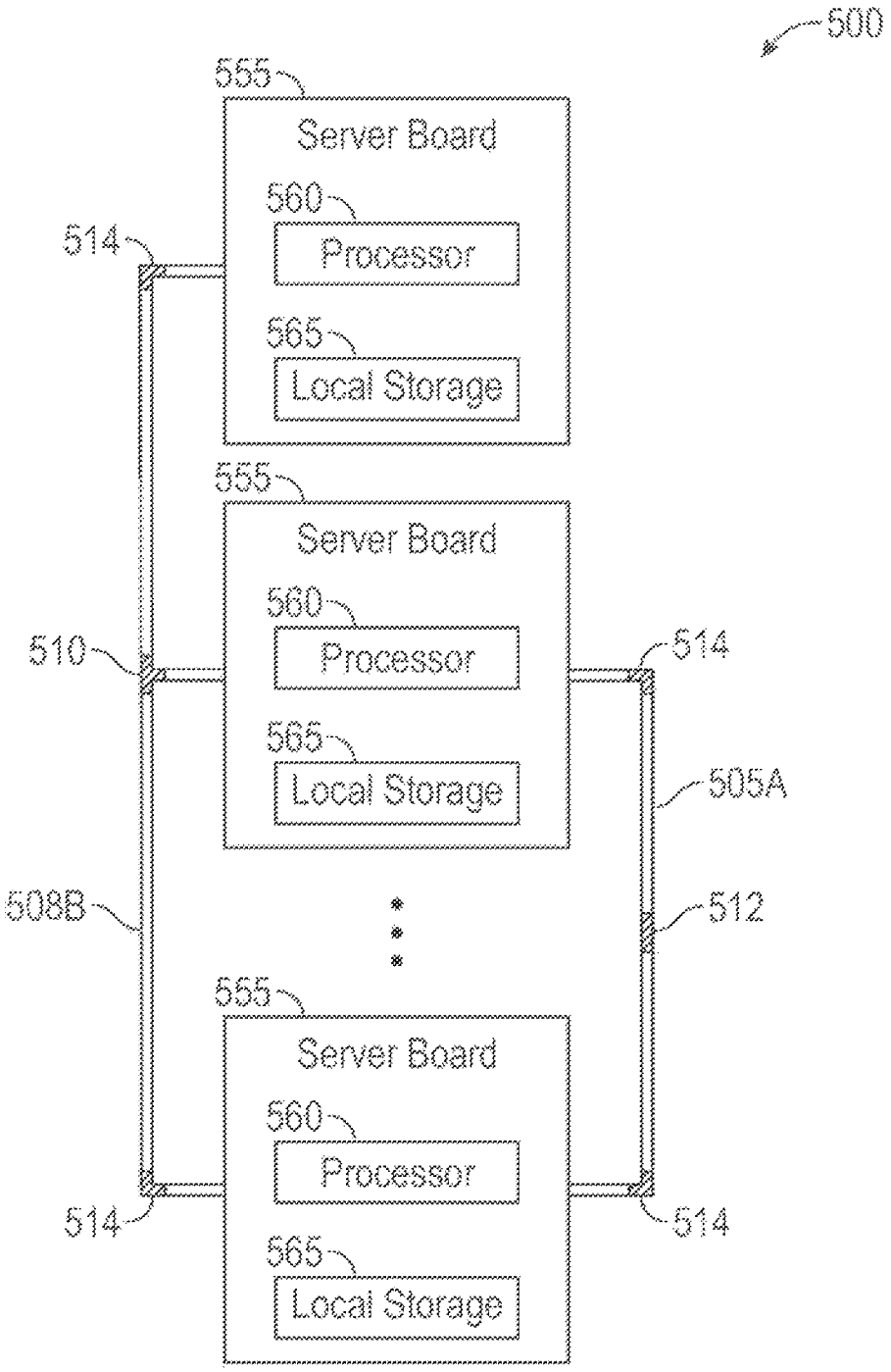
FIG. 5 is a block diagram of an electronic system in accordance with some embodiments.

FIG. 4B is an illustration of the waveguide sections joined together into the assembled waveguide. The joining features of the waveguide sections can be joined together at waveguide junctions 422. The waveguide junctions can include a conductive adhesive material, such as one or both of a conductive tape (or ribbon) or a conductive paste. The conductive tape can include a conductive polymer or can include metal. The ends of the assembled waveguide can be operatively connected to waveguide launchers and transceivers. The joined waveguide is dimensioned to carry electromagnetic signals having wavelengths in the millimeters and micrometers and frequencies in the sub-Terahertz frequency range. In certain embodiments, the joined waveguides are dimensioned to carry signals having frequencies of 30 Gigahertz (GHz) to 300 GHz. In certain embodiments, the joined waveguides are dimensioned to carry signals having frequencies of 100 GHz to 900 GHz FIG. 5 is a block diagram of an electronic system 500 incorporating waveguide assemblies in accordance with at least one embodiment of the invention. Electronic system 500 is merely one example in which embodiments of the present invention can be used. The electronic system 500 of FIG. 5 comprises multiple servers or server boards 555 interconnected as a server cluster that may provide internet cloud services. A server board 555 may include one or more processors 560 and local storage 565. Only three server boards are shown to simplify the example in FIG. 5. A server cluster may include hundreds of server units arranged on boards or server blades in a rack of servers, and a server cluster can include dozens of racks of server blades. Racks can be placed side-by-side with a back-plane or back-panel used to interconnect the racks. Server switching devices can be included in the racks of the server cluster to facilitate switching among the hundreds of server units.

The server boards in FIG. 5 are shown interconnected using waveguides 505A and 505B, although an actual system would include hundreds of rack-to-rack and within rack interconnections. The waveguides can be hollow or can include a dielectric waveguide core. The waveguides can include one or more "T" shaped sections 510, "I" shaped sections 512, and "L" shaped sections 514. The waveguides are operatively connected to ports of the servers, such as by waveguide launchers for example. There can be multiple levels of interconnect between servers. These levels can include within server blade interconnect, within server rack interconnect, rack-to-rack interconnect and rack-to-switch interconnect. The waveguides 505A, 505B are used for at least a portion of the interconnect within the server system, and can be used for any of the within server blade, within server rack, rack-to-rack, and rack-to-switch interconnections. In certain embodiments, the waveguides form at least a portion of back-panel interconnections for a server cluster.

Figure 6:
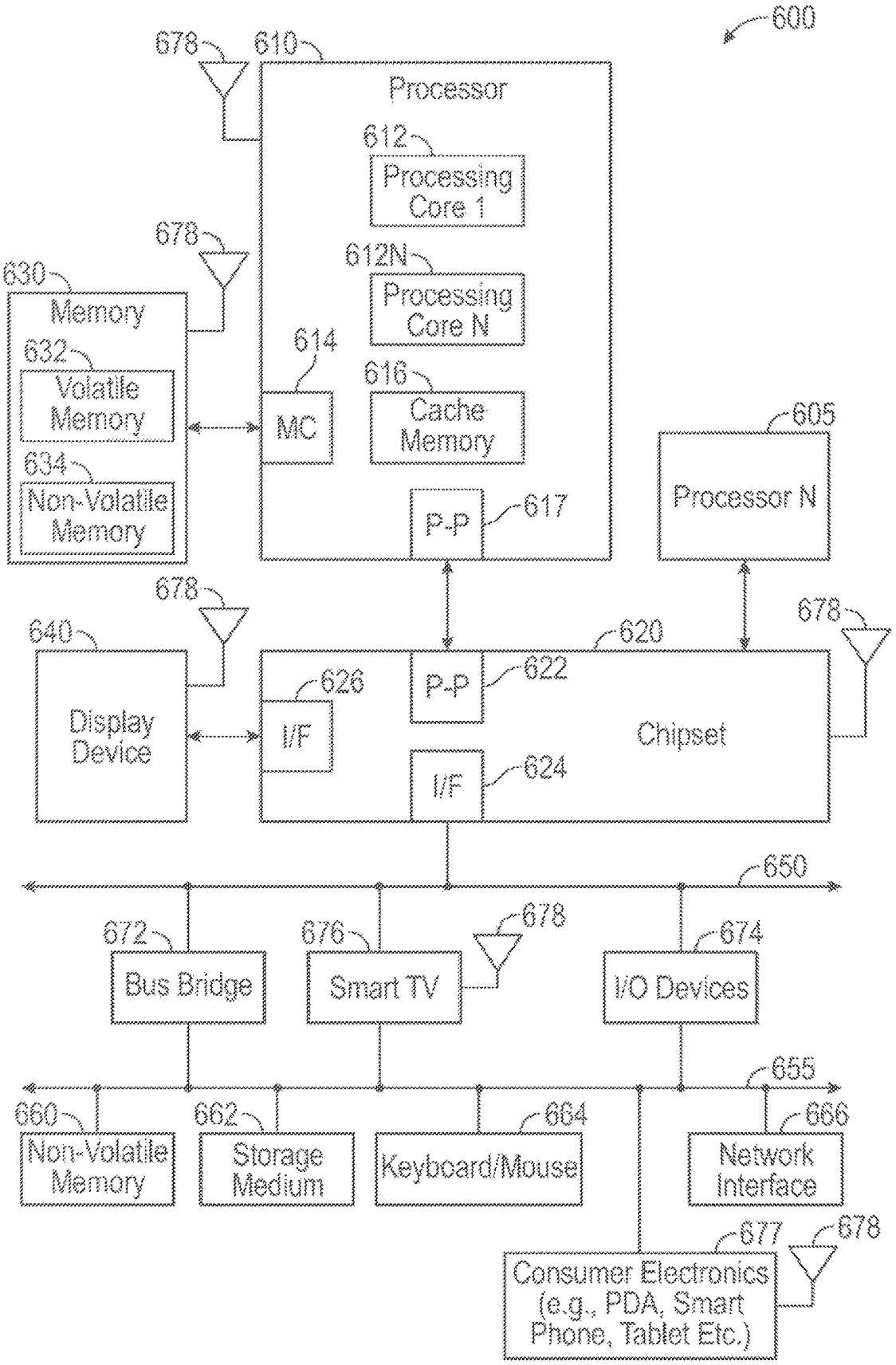
FIG. 6 is an illustration of another electronic system in accordance with some embodiments.

FIG. 6 illustrates a system level diagram, according to one embodiment of the invention. For instance, FIG. 6 depicts an example of an electronic device (e.g., system) that can include the waveguide interconnections as described in the present disclosure. In one embodiment, system 600 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 600 is a system on a chip (SOC) system. In one example two or more systems, as shown in FIG. 6 may be coupled together using one or more waveguides as described in the present disclosure. In one specific example, one or more waveguides as described in the present disclosure may implement one or more of busses 650 and 655.

In one embodiment, processor 610 has one or more processing cores 612 (Processor Core 1) and 612N (Processor Core N), where 612N represents the Nth processor core inside processor 610 and where Nis a positive integer greater than zero. In one embodiment, system 600 includes multiple processors including processor 610 and processor N 605, where processor 605 has logic similar or identical to the logic of processor 610. In some embodiments, processing core 612 includes, but is not limited to, pre-fetch logic to fetch instructions, decode logic to decode the instructions, execution logic to execute instructions and the like. In some embodiments, processor 610 has a cache memory 616 to cache instructions and/or data for system 600. Cache memory 616 may be organized into a hierarchal structure including one or more levels of cache memory In some embodiments, processor 610 includes a memory controller 614 (MC), which is operable to perform functions that enable the processor 610 to access and communicate with memory 630 that includes a volatile memory 632 and/or a non-volatile memory 634. In some embodiments, processor 610 is coupled with memory 630 and chipset 620 Processor 610 may also be coupled to a wireless antenna 678 to communicate with any device configured to transmit and/or receive wireless signals. In one embodiment, the wireless antenna interface 678 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 632 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 634 includes, but is not limited to, flash memory, phase change memory (PCM), read-only memory (ROM), electrically erasable programmable read-only memory (EEPROM), or any other type of non-volatile memory device.

Memory 630 stores information and instructions to be executed by processor 610. In one embodiment, memory 630 may also store temporary variables or other intermediate information while processor 610 is executing instructions. In the illustrated embodiment, chipset 620 connects with processor 610 via Point-to-Point (PtP or P-P) interfaces 617 and 622. Chipset 620 enables processor 610 to connect to other elements in system 600. In some embodiments of the invention, interfaces 617 and 622 operate in accordance with a PtP communication protocol such as the Intel® QuickPath Interconnect (QPI) or the like. In other embodiments, a different interconnect may be used.

In some embodiments, chipset 620 is operable to communicate with processor 610, processor N 605, display device 640, and other devices 672, 676, 674, 660, 662, 664, 666, 677, etc. Buses 650 and 655 may be interconnected together via a bus bridge 672. Chipset 620 connects to one or more buses 650 and 655 that interconnect various elements 674, 660, 662, 664, and 666. Chipset 620 may also be coupled to a wireless antenna 678 to communicate with any device configured to transmit and/or receive wireless signals. Chipset 620 connects to display device 640 via interface 626 (I/F). Display 640 may be, for example, a liquid crystal display (LCD), a plasma display, cathode ray tube (CRT) display, or any other form of visual display device. In some embodiments of the invention, processor 610 and chipset 620 are merged into a single SOC. In one embodiment, chipset 620 couples with a non-volatile memory 660, a mass storage medium 662, a keyboard/mouse 664, and a network interface 666 via interface 624 (I/F), I/O device(s) 674, smart TV 676, consumer electronics 677 (e.g., PDA, smart phone, tablet. etc.).

In one embodiment, mass storage medium 662 includes, but is not limited to, a solid state drive, a hard disk drive, a universal serial bus flash memory drive, or any other form of computer data storage medium. In one embodiment, network interface 666 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV (HPAV), Ultra Wide Band (UWB), Bluetooth, WiMax, or any form of wireless communication protocol While the modules shown in FIG. 6 are depicted as separate blocks within the system 600, the functions performed by some of these blocks may be integrated within a single semiconductor circuit or may be implemented using two or more separate integrated circuits. For example, although cache memory 616 is depicted as a separate block within processor 610, cache memory 616 (or selected aspects of 616) can be incorporated into processor core 612.

Figure 7:
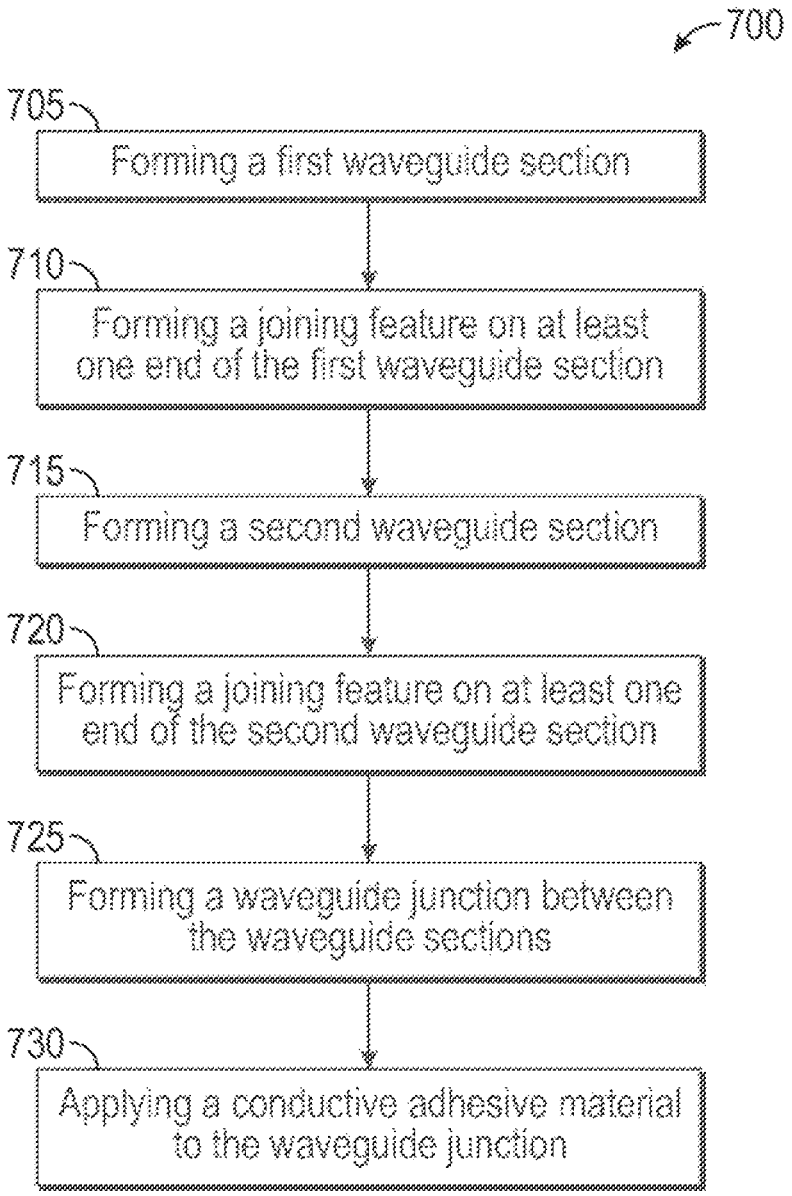
FIG. 7 is a flow diagram of an embodiment of making a waveguide in accordance with some embodiments.

FIG. 7 is a flow diagram of an embodiment of a method 700 of making a waveguide. At step 705 a first waveguide section is formed. The first waveguide section includes an outer layer of conductive material tubular in shape and having multiple ends. The waveguide section may be hollow or the waveguide section can include a waveguide core of dielectric material. The first guide section may have an "I"

shape, an "L" shape, or a "T" shape. At step 710, a joining feature is formed on at least one of the ends of the first waveguide section.

At step 715, a second waveguide section is formed. The second waveguide section also includes an outer layer of conductive material tubular in shape and having multiple ends. Like the first waveguide section, the second waveguide section can have an "I" shape, an "L" shape, or a "T" shape. At step 720, a joining feature is formed on at least one of the ends of the second waveguide section. At step 725, a waveguide junction between the waveguide sections is formed by joining the joining feature of the second waveguide section to the joining feature of the first waveguide section. At step 730, a conductive adhesive material is applied to the waveguide junction. Additional section can be added to the waveguide as needed to make the desired connections. The assembled waveguides can be operatively connected to waveguide antennas and transceivers.

ADDITIONAL DESCRIPTION AND EXAMPLES

Example 1 can include subject matter (such as an apparatus) comprising: a waveguide section including an outer layer of conductive material tubular in shape and having multiple ends; and a joining feature on at least one of the ends of the waveguide section configured for joining to a second separate waveguide section.

In Example 2, the subject matter of Example 1 optionally includes a waveguide section that includes two ends and a joining feature on each end of the waveguide.

In Example 3, the subject matter of one or both of Examples 1 and 2 optionally includes a waveguide section that includes an "L" shape.

In Example 4, the subject matter of one or any combination of Examples 1-3 optionally includes a waveguide section that includes three ends and a joining feature on each end of the waveguide.

In Example 5, the subject matter of one or any combination of Examples 1-4 optionally includes a waveguide section that includes a "T" shape.

In Example 6, the subject matter of one or any combination of Examples 1-5 optionally includes a waveguide section that includes a waveguide core of dielectric material within the outer layer.

In Example 7, the subject matter of Example 6 optionally includes a joining feature is a receptacle connector of a receptacle-plug connector pair.

In Example 8, the subject matter of Example 6 optionally includes a joining feature is a plug connector of a plug-receptacle pair.

In Example 9, the subject matter of one or any combination of Examples 6-8 optionally includes a waveguide core that has a tubular shape and a hollow center.

In Example 10, the subject matter of one or any combination of Examples 6-9 optionally includes the dielectric material of the waveguide core including at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

In Example 11, the subject matter of one or any combination of Examples 1-5 optionally includes a waveguide section that is hollow.

In Example 12, the subject matter of one or any combination of Examples 1-5 and 11 optionally includes a joining feature that is a male connector of a male-female connector pair.

In Example 13, the subject matter of one or any combination of Examples 1-5 and 11 optionally includes a joining feature that is a female connector of a female-male connector pair.

In Example 14, the subject matter of one or any combination of Examples 1-13 optionally includes the conductive material of the outer layer including a conductive polymer.

In Example 15, the subject matter of one or any combination of Examples 1-14 optionally includes the conductive material of the outer layer including at least one of includes at least one of copper, gold, silver, or aluminum.

In Example 16, the subject matter of one or any combination of Examples 1-15 optionally includes a width of a cross section of the waveguide section is less than ten millimeters (10 mm).

In Example 17, the subject matter of one or any combination of Examples 1-16 optionally includes a width of a cross section of the waveguide section is less than one millimeter (1 mm).

Example 18 includes subject matter (such as an apparatus), or can optionally be combined with one or any combination of Examples 1-17 to include such subject matter, comprising a first waveguide section including: an outer layer of conductive material tubular in shape and having multiple ends; and a joining feature on at least one of the ends; and a second waveguide section including an outer layer of conductive material tubular in shape and having multiple ends; and a joining feature joined to the joining feature of the first waveguide section.

In Example 19, the subject matter of Example 18 optionally includes a the joining feature of the second waveguide section is joined to the joining feature of the first waveguide section at a waveguide junction, and wherein the waveguide junction includes a conductive adhesive material.

In Example 20, the subject matter of Example 19 optionally includes conductive adhesive material that includes one of a conductive tape or a conductive paste.

In Example 21, the subject matter of one or any combination of Examples 18-20 optionally includes the first waveguide section and the second waveguide section include a waveguide core of dielectric material within the outer layer of conductive material.

In Example 22, the subject matter of one or any combination of Examples 18-21 optionally includes the waveguide including more than two waveguide ends.

Example 23 includes subject matter (such as a system) or can optionally be combined with one or any combination of Examples 1-22 to include such subject matter, comprising a first server and a second server, wherein the first and second servers each include a plurality of ports; and a waveguide operatively coupled to a first port of the first server and a first port of the second server, wherein the waveguide includes a plurality of joined waveguide sections, wherein the waveguide sections include an outer layer of conductive material that is tubular in shape, and the waveguide sections are joined using a joining feature arranged on at least one end of the outer layer of the waveguide sections.

In Example 24, the subject matter of Example 23 optionally includes the joined waveguide sections each include a waveguide core of dielectric material within the outer layer of conductive material.

In Example 25, the subject matter of one or both of Examples 23 and 24 optionally includes the joining feature of the second waveguide section is joined to the joining feature of the first waveguide section at a waveguide junction, and wherein the waveguide junction includes a conductive adhesive material.

In Example 26, the subject matter of one or any combination of Examples 23-25 optionally includes at least one waveguide section of the plurality of waveguide sections includes more than two ends.

In Example 27, the subject matter of one or any combination of Examples 23-26 optionally includes a waveguides configured to communicate a signal having a frequency of thirty Gigahertz (30 GHz) or greater.

In Example 28, the subject matter of one or any combination of Examples 23-27 optionally includes a third server including a first port, wherein the waveguide is operatively coupled to the first port of the first server, the first port of the second server, and the first port of the third server.

These non-limiting examples can be combined in any permutation or combination.

The Abstract is provided to allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system comprising:

a first server and a second server, wherein the first and second servers each include a first port among a plurality of ports; and a waveguide operatively coupled to a first port of the first server and a first port of the second server, wherein the waveguide includes a plurality of joined waveguide sections, wherein the plurality of joined waveguide sections include a respective outer layer of conductive material that is tubular in shape, and the plurality of joined waveguide sections are joined using a respective joining feature arranged on at least one end of the corresponding outer layer of the plurality of joined waveguide sections, wherein the joining feature of the second waveguide section is joined to the joining feature of the first waveguide section at a waveguide junction, and wherein the waveguide junction includes a conductive adhesive material.

2. The system of claim 1, wherein the plurality of joined waveguide sections each include a respective waveguide core of dielectric material within the corresponding outer layer of conductive material.

3. An apparatus comprises a waveguide including:

a first waveguide section including: an outer layer of conductive material tubular in shape and having multiple ends; and a joining feature on at least one of the ends; and a second waveguide section including an outer layer of conductive material tubular in shape and having multiple ends, and a joining feature joined to the joining feature of the first waveguide section, wherein the joining feature of the second waveguide section is at a waveguide junction that includes one of a conductive tape or a conductive paste.

4. The apparatus of claim 3, wherein the first waveguide section and the second waveguide section include a respective waveguide core of dielectric material within the corresponding outer layer of conductive material.

5. The apparatus of claim 3, wherein the multiple ends of the first and second waveguide sections include more than two waveguide ends.

6. An apparatus comprises:

a waveguide section including an outer layer of conductive material tubular in shape and having multiple ends; and a joining feature on at least one of the multiple ends of the waveguide section configured for joining to a second separate waveguide section, wherein a width of a cross section of the waveguide section is less than ten millimeters (10 mm).

7. The apparatus of claim 6, wherein the conductive material of the outer layer includes a conductive polymer.

8. The apparatus of claim 6, wherein the conductive material of the outer layer includes at least one of includes at least one of copper, gold, silver, or aluminum.

9. The apparatus of claim 6, wherein the waveguide section includes a waveguide core of dielectric material within the outer layer.

10. The apparatus of claim 9, wherein the joining feature is a receptacle connector of a receptacle-plug connector pair.

11. The apparatus of claim 9, wherein the joining feature is a plug connector of a plug-receptacle pair.

12. The apparatus of claim 9, wherein the waveguide core has a tubular shape and a hollow center.

13. The apparatus of claim 9, wherein the dielectric material of the waveguide core includes at least one of polyethylene (PE), polytetrafluoroethylene (PTFE), perfluoroalkoxy alkanes (PFA), fluorinated ethylene propylene (FEP), polyvinylidene fluoride (PVDF), liquid crystal polymer (LCP), or ethylene-tetraflouroethylene (ETFE).

14. The apparatus of claim 6, wherein the waveguide section is hollow.

15. The apparatus of claim 14, wherein the joining feature is a male connector of a male-female connector pair.

16. The apparatus of claim 14, wherein the joining feature is a female connector of a female-male connector pair.

17. The apparatus of claim 6, wherein the multiple ends of the waveguide section include three ends and wherein the joining feature on at least one of the ends includes a joining feature on each end of the waveguide section.

18. The apparatus of claim 17, wherein the waveguide section includes a "T" shape.

19. The apparatus of claim 6, wherein the width of a cross section of the waveguide section is less than one millimeter (1 mm).

20. The apparatus of claim 6, wherein the multiple ends of the waveguide section include two ends and wherein the joining feature on at least one of the ends includes a joining feature on each end of the waveguide.

21. The apparatus of claim 20, wherein the waveguide section includes an "L" shape.

* * * * *